United States Patent [19]

Wood

[11] 4,390,574

[45] Jun. 28, 1983

[54] FELT MATERIAL OF LAYER OF FINE DENIER FELT AND LAYER OF COARSE DENIER FELT

[75] Inventor: Eric Wood, Wakefield, England

[73] Assignee: Insituform International Inc., Channel Islands

[21] Appl. No.: 288,760

[22] Filed: Jul. 31, 1981

[30] Foreign Application Priority Data

Jul. 31, 1980 [GB] United Kingdom ..... 8025043
Feb. 19, 1981 [GB] United Kingdom ..... 8105184

[51] Int. Cl.[3] ..... B32B 5/16

[52] U.S. Cl. ..... 428/36; 428/212; 428/281; 428/283; 428/300

[58] Field of Search ..... 428/36, 281, 283, 300, 428/212; 156/156, 276, 287, 294

[56] References Cited

U.S. PATENT DOCUMENTS 4,250,172 2/1981 Mutzenberg ..... 428/283

FOREIGN PATENT DOCUMENTS 1449455 9/1976 United Kingdom .

*Primary Examiner*—Marion McCamish
*Attorney, Agent, or Firm*—Fred Philpitt

[57] ABSTRACT

The present invention relates to the provision of a filling material such as an inorganic filler in the felt, especially a needled felt. The resulting felt material is formed into a tube for use in a passageway lining process in which the felt material is soaked in a curable resin. The purpose of the filling material is to reduce the quantity of resin required to impregnate the felt, thereby to reduce the cost of the process.

3 Claims, 5 Drawing Figures

FELT MATERIAL OF LAYER OF FINE DENIER FELT AND LAYER OF COARSE DENIER FELT

This invention relates to felt material and the manufacture and use thereof and in particular concerns a process whereby there will be produced a felt material containing a filling material.

The present invention is concerned with the production of a felt which is usable in connection with the process described in British Pat. No. 1449455. The process described in that patent comprises the lining of a passageway, especially an underground passageway, with a tube of felt material bonded on the outside by a liquid impermeable membrane, which felt is soaked in a synthetic resin. The saturated felt tube is everted into the passageway by means of a liquid, the liquid serving two purposes, namely to shape the tube to the shape of the passage to be lined, and secondly to perform the eversion of the tube into the passageway. In order to make the process most effective, the specific gravity of the soaked tube should be a reasonable match to the specific gravity of the everting liquid so that the section of the tube which is being supported by the liquid as it travels through the passageway will be of sensibly neutral buoyancy. The present invention is concerned with the filling of the felt for forming the said tube, or at least one or more layers thereof, when the tube is formed as a plurality of layers of felt.

The present invention is concerned with providing fillers in the felt in order that the amount of resin to soak the felt will be reduced, thereby reducing the cost of the lining process, the resin tending to be the most expensive component.

Where the filler material is used in the felt, and the same resin system and everting liquid (usually water) are to be used, it is desirable to select the filler to have a specific gravity of the same order as the felt and therefore in accordance with a first aspect of the present invention there is provided a felt material comprising felt embodying a filler which is of substantially the same specific gravity as the felt.

The filler will preferably be an inorganic filler, such as Filite (Trade Mark).

Where the resin system to be used in the eversion process or the everting liquid can be varied as the specific gravity, then it is not necessary that the filling material should have the same specific gravity as the felt and in accordance with another aspect of the present invention there is provided a method of lining a passageway comprising everting into the passageway a liner tube comprising an inner felt layer and an outer impermeable layer, the inner felt layer including a filling material and being impregnated with a curable resin, the method including using a liquid to evert the liner tube and selecting the felt, filling material, resin and liquid so that the specific gravity of the impregnated lining tube is substantially equal to that of the liquid whereby the liner tube will be supported with substantially neutral buoyancy as it passes along the inside of the passageway.

The passageway may of course be a pipe or pipeline, and the passageway may be underground or above ground.

Usually, the liquid for everting will be water, and conventional resin systems such as epoxy or polyester resin systems will be used, which means that the filling material should be approximately the same specific gravity as the felt so that the resulting felt and filling material should have a specific gravity approximating to that of the felt alone.

The filling material is preferably an inorganic particulate material such as Filite or crushed olive stone and it may be introduced into the felt by being presented in the form of a slurry at a point in the process of felt manufacture, typically before a needling stage, when the felt is a needled felt.

If the filling material is a composite including two components, typically glass fibre and an inorganic particulate material, the said components should have a combined specific gravity which is the same as the felt in those cases where there is no specific gravity change in the resin system or liquid.

It is also a requirement of the present invention however, that the felt material should be of good strength characteristics, as well as to reduce the amount of resin which is required thoroughly to soak the felt, without any overall loss in characteristics of the finished, hard resin lining.

One method of producing a fibrous felt which is quite well known comprises the production of a continuous lap or laps of fibres from a carding plant. The carded lap or laps is or are fed to a lapping mechanism or lapping mechanisms which folds or fold the lap or laps backwards and forwards on a support surface which moves in a direction transverse to the lapping direction of the lapping mechanism, this direction being traditionally at right angles to the lapping direction. The speed of the transverse feed and the rate of reciprocation of the lapping mechanism determine the final thickness of the felt material, whilst the amplitude of movement of the lapping mechanism determines the final width of the felt material, and each of these parameters can be varied as desired.

The thus folded web or webs passes or pass to a needling machine which needles through the folded layers thereby firmly to connect same together and to form a coherent interlinked web or fibres.

In the present invention, in one embodiment, the needled felt was strengthened by blowing chopped glass fibres onto the web prior to a needling stage so that the subsequent needling will firmly entangle the chopped glass fibres with the fibres of the felt.

Preferably, the glass fibres are blown on to the web along a central region of which the edges are spaced equally inwardly from the edges of the web. The chopped glass fibres may be blown onto the lower or upper and lower webs which come together prior to passing through said needling stage.

Such a material is much stronger than felt without the glass fibres, but the introduction of the glass fibre increases the specific gravity of the felt and therefore to enable the felt to be used in the lining process described herein without changing the specific gravity of the resin or everting liquid, suitable filling material is introduced into the felt to retain the specific gravity similar to that of the felt without the glass fibres. By choosing a suitable filler, the overall specified gravity of the material can be brought back to close to that of the felt alone, which is approximately 1.

An embodiment of the invention will now be described, by way of example, with reference to the accompanying drawings, wherein.

Figure 1:
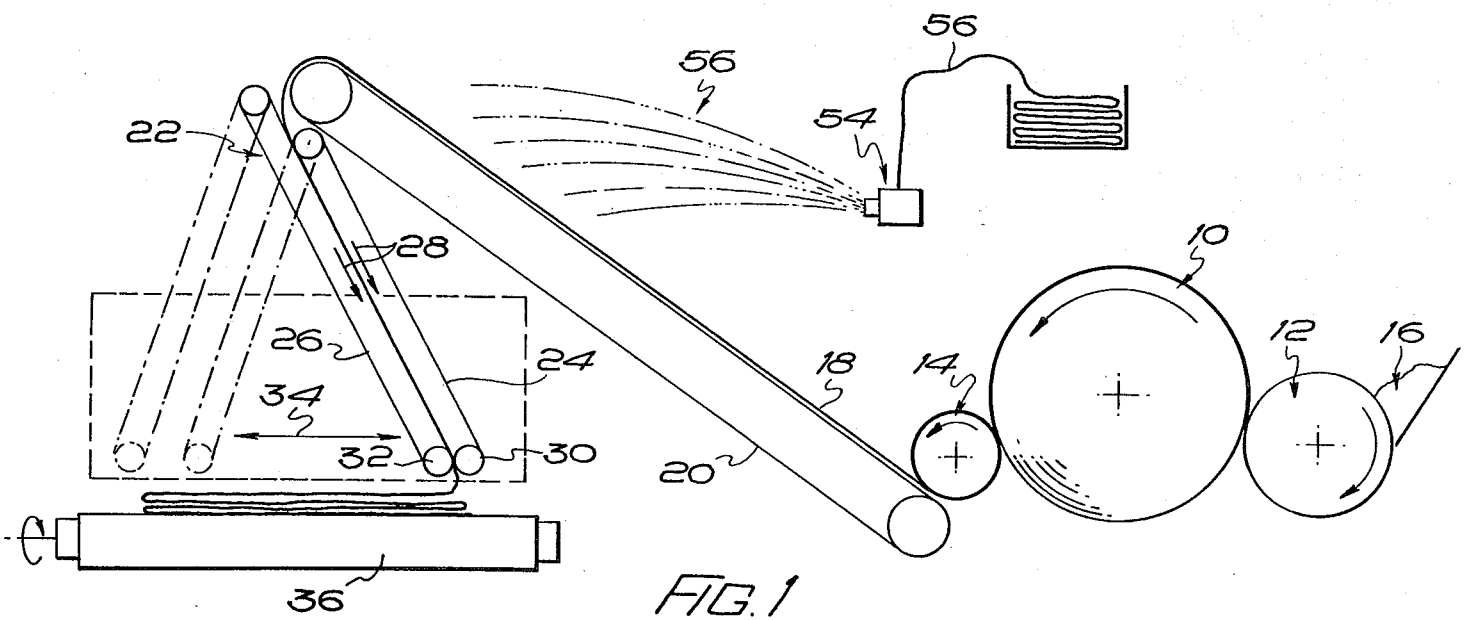
FIG. 1 is a diagrammatic view of lapper apparatus for use in carrying out the method according to the embodiment of the invention.
Figure 2:
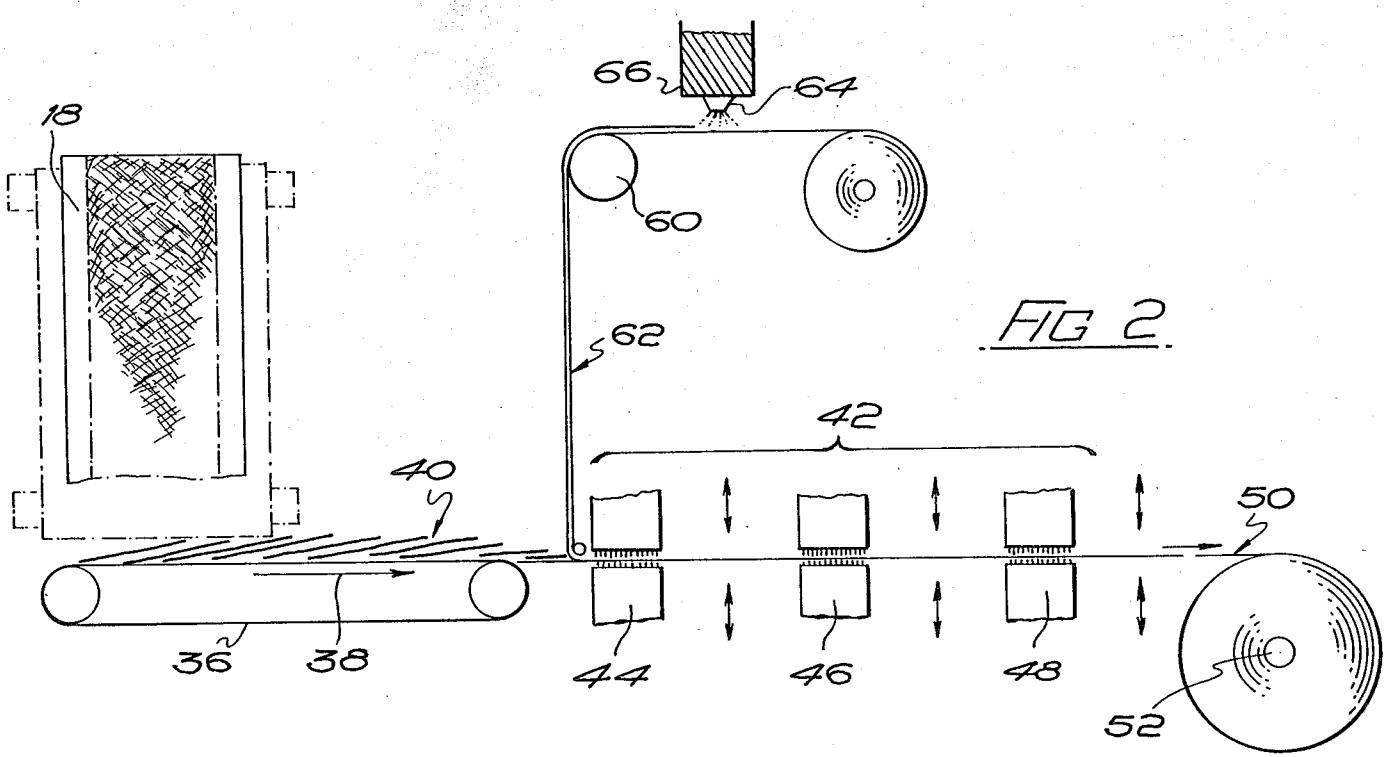
FIG. 2 is a diagrammatic side view showing the needling stage of the apparatus shown in FIG. 1.
Figure 3:
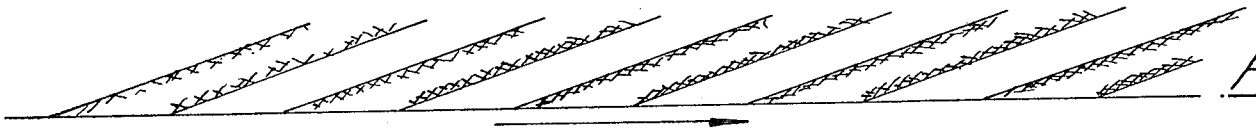
FIG. 3 is a sectional side view showing the folded web as it passes to the needling stage of the equipment shown in FIGS. 1 and 2.

FIG. 1 shows the carding and lapper section of a plant for producing needled felt material, whilst FIG. 2 shows the needling stage. In FIG. 1, reference numerals 10 to 14 indicate the various rollers of a carding engine to which is fed loose fibrous material 16. That fibrous material 16 emerges from the doffer roller 14 in the form of a carded web 18, and is transported upwardly by means of an elevator conveyor 20 to the top end of a lapper mechanism 22 which comprises a pair of slat conveyors 24 and 26, which respectively travel in the directions indicated by the arrows 28 in FIG. 1. The carded lap 18 is fed between the opposing and contacting faces of the conveyors 24 and 26 and emerges from the bottom end of the lapper mechanism 22 as shown. The said bottom end, which is defined by a pair of guide rollers 30 and 32, in fact reciprocates back and forth as indicated by the arrow to lay the lap in back and forth folded condition on the conveyor 36. If reference is made to FIG. 2, the conveyor 36 is seen in side elevation, and its direction of travel is indicated by arrow 38. It will be seen therefore that as the carded web 18 is folded back and forth on the conveyor 36, it is also transported in the direction of transportation 38 so that in fact a folded web 40 results and this is presented to the needling stage 42 of the plant. In this example, three needling stations 44, 46 and 48 are shown, and the resulting felt material is shown at 50 as being wound into reel form 52. The arrangement described in relation to FIGS. 1 and 2 up to this point, is completely conventional, but in accordance with this embodiment of the invention, chopped glass fibres are applied to the lap 18 as it travels up the elevator conveyor 20, and referring again to FIG. 1, reference numeral 54 indicates a chopping and blowing device to which glass filament strand 56 is supplied. The strand which comprises a multiplicity of filaments is chopped by the device 54, and the chopped glass fibres are blown as indicated at 56A onto the upwardly moving lap 18. If reference is made to FIG. 2, it will be seen that the fibres 57 in fact occupy a region inwardly spaced of the edges of the lap 18, and if reference is made to FIG. 3, it will be seen that the glass fibres lie between alternate opposed pairs of faces of the folded lap, but in any event by virtue of the method of placing the glass fibres on the lap 18, and lapping operation, there is an even distribution of glass fibres throughout the web.

Inclusion of glass fibres in the web has the effect of increasing the specific gravity of the web, as the glass fibres are much heavier than the fibres of the material 16, which fibres may for example by polyester or polyurethane fibres, and because of this alteration of the specific gravity, there is added to the final material 50 an inorganic filler which has the effect of bringing back the specific gravity of the resulting web 50 to that of the fibrous material 16, which in fact is approximately 1. The filler material is added by the arrangement illustrated in FIG. 2. A web of felt material, of the same material as the lap 18 is unwound over a guide roller 60, and then passes downwardly to a point in front of the needling station 44, so that the said web of felt and the folded lap 40 pass together through the needling stages and are connected and consolidated into the final web 50. The said further web, identified by numeral 62, in fact serves also as a carrier for the filler material which is a gel or slurry like substance sprayed from a nozzle 64 associated with the supply of the filler 66. It will be appreciated that the filler in fact is trapped between the web 62 and the folded lap 40. In this example the filler is mainly of Filite (as sold by Filite Limited) Texicryl (as sold by Scott Bader) ammonia and water to provide the gel like or slurry substance, but other filler arrangements can be used, and in fact in an alternative embodiment we propose that the Filite by used in dry condition and vibrated onto, for example, the upper surface of the lap 40, the additional web 62 being supplied without any filler material thereon.

As well as redressing the specific gravity of the resultant material 50, the filler also in fact provides filling of the material to such an extent that less synthetic resin will be required when the material is used in the lining process, as described in British Patent Specification No. 1,449,455.

One problem which can occur with the utilisation of fillers as described however is that it is not so easy to achieve the effective wetting out of the felt material, because the fillers do effect the viscosity flow characteristics of the mix as compared to neat resin. It should be borne in mind furthermore that in order to wet out a felt tube, especially a tube which is necessary for the method outlined in British Pat. No. 1449455, the tube is wetted out whilst it is flat, and a vacuum is used to remove air from inside the bag, so that the resulting vacated space will be filled with resin, including the air spaces within the body of the felt material. If this technique is used with a felt which has fillers, the fillers tend to separate out from the resin, which of course is completely unsatisfactory.

According to a preferred feature of the invention therefore a felt construction is provided which overcomes such disadvantages, and which is usable in accordance with the method of the present invention.

The felt comprises a felt of relatively fine denier, and a felt of relatively course denier, these two felt layers being made integral to form the composite felt. The course and fine denier layers may be the layers 40 and 62 which are directly needled together, or there may be a further woven layer or the like between the fine and course felt layers.

Typical of coarse and fine denier felts are 100 denier felts and 6 denier felts.

The coarse denier felt, typically 100 denier, is a relatively loose and open structure into which resin and fillers penetrate easily, whereas the fine denier felt, typically 6 denier, provides strength. Preferably the coarse denier felt will be 3 or 4 times as thick as the fine denier felt, as it will absorb the bulk of the resin and filler mixture when used in a lining method as described herein.

The coarse denier felt is preferably needled to the fine denier felt by a needling operation in which the needles pass first through the course denier felt and then through the fine denier felt.

In the application for which the felt is designed, when the felt is used for the lining process as referred to herein, the felt is formed into a tube with the coarse denier felt inside. The felt may be formed into a tube having a longitudinal seam which is established by sewing.

When, as described herein, the felt forms an outer layer of a lining tube for the process as herein described, the outer surface of the fine felt is provided with a fluid impermeable coating such as a polyurethane skin, and it may be formed into a tube as described and illustrated in British Patent Specification No. 8039077.

Although tests carried out have indicated that felts of coarseness of 100 denier and felts of fineness of 6 denier have worked satisfactorily, with the resin and filler mixture as specified herein, it is to be appreciated that the respective deniers of the coarse and fine felts can be adjusted to suit the resin composition being used.

Figure 4:
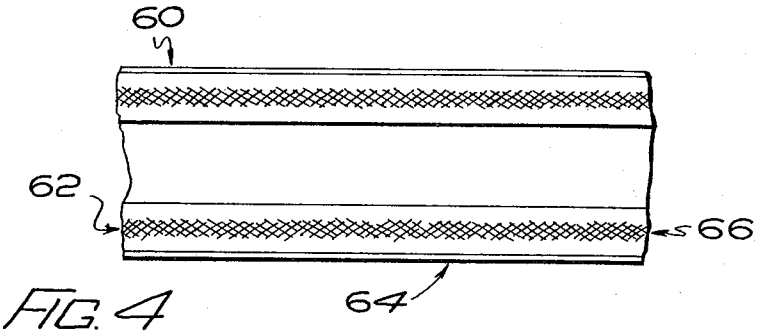
FIG. 4 is a sectional elevation of a length of inner tube made from felt produced by the apparatus of FIG. 1 and 2.
Figure 5:
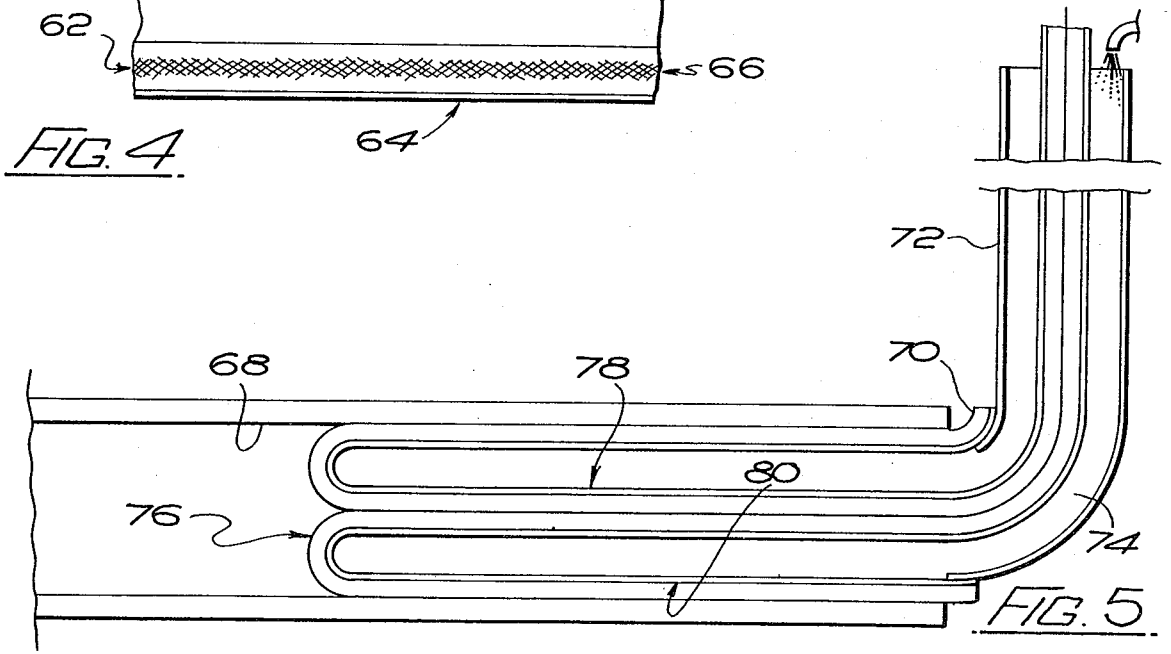
FIG. 5 is a diagrammatic sectional elevation showing the method of inserting the liner tube of which a length is shown in FIG. 4.

Turning now to FIGS. 4 and 5, in FIG. 4 there is shown a length 90 of a liner tube, comprising a felt layer 92 to the inside, and to the outside there is a fluid impermable membrane 94 which form a coating or a separate lining tube. It will normally be a coating of the outside of the felt layer 92. Felt layer 92 has the filling 96 which may be inorganic filling material and glass fibres as described herein, which together do not effect the specific gravity of the original felt material, or may be simply an inorganic filler material of a specific gravity equal to that of the felt. The felt material may be introduced as described herein. Although the length of lining tube is shown as being open in the interest of clarity, normally it will be in flattened form (the lining tube is flexible), having been filled with the curable resin which impregnates the felt layer 92, by introducing the resin to the inside of the bag, by rolling same between squeeze rollers if desired, and by applying a vacuum to the inside of the bag to withdraw air from the inside of the bag.

FIG. 5 shows how the bag is applied to an underground passageway 68. One end 70 of the bag is anchored to the lower end of the feed pipe 72 located adjacent the end of the passageway 68. The everting liquid 74 is introduced into the feed pipe in order to evert the bag as shown at 76 into and along the passageway 68. The everting liquid serves to hold the everted portion of the bag against the surface or passageway 68, as well as to perform the eversion, and it will be noticed that the section 78 travels along the inside of the passageway 68 through the already everted portion 80, and the liquid 74 serves to support the section 78 in a buoyant fashion thereby to minimise friction between the portion 78 and the already everted portion 80. It is for this reason that the filler 66, the felt 62, the impregnated resin and the everting liquid are chosen that there is matching of the specific gravities to give the Section 78 substantially equal buoyancy in the liquid. This feature enables long lengths of lining bag to be inserted.

Therefore, if filling material is introduced into the felt, and the resin and everting liquid remain unchanged, then the filling material should be the same specific gravity as the felt. However, if the specific gravity of the lining or everting liquid can be changed, it will be possible for the filling material to have a specific gravity different from that of the felt and indeed to change the overall specific gravity of the resulting material, provided that the said neutral buoyancy effect described above is achieved.

I claim:

1. A felt material comprising (a) at least one layer of felt of fine denier, (b) at least one layer of felt of coarse denier, and (c) a filling material having a specific gravity substantially the same as that of said felt.

2. A felt material according to claim 1, wherein said felt material is formed into a tube, said at least one layer of felt of fine denier being adjacent the outer surface of said tube, and said at least one layer of felt of coarse denier being adjacent the inner surface of said tube.

3. A felt material according to claim 2, wherein the outer surface of said felt tube is coated with a liquid impermeable membrane.

* * * * *